United States Patent [19]

Steinhardt

[11] Patent Number: 4,582,083

[45] Date of Patent: Apr. 15, 1986

[54] DISCHARGE REGULATOR

[76] Inventor: Lothar Steinhardt, Panoramastr. 44, 6204 Taunusstein 2, Fed. Rep. of Germany

[21] Appl. No.: 636,317

[22] Filed: Jul. 27, 1984

[30] Foreign Application Priority Data

Jul. 29, 1983 [DE] Fed. Rep. of Germany ..... 3327404
May 17, 1984 [DE] Fed. Rep. of Germany ... 8415035[U]

[51] Int. Cl.[4] ..... F16K 31/18; F16K 33/00

[52] U.S. Cl. ..... 137/398; 137/434; 137/446; 251/208; 251/294; 73/322.5

[58] Field of Search ..... 137/395, 397, 398, 446, 137/448, 101.25, 101.27, 434; 251/294, 208; 73/322.5

[56] References Cited

U.S. PATENT DOCUMENTS

| | | | |
|---|---|---|---|
| 812,211 | 2/1906 | Kunz | 137/397 |
| 1,212,339 | 1/1917 | Fosdick | 137/101.25 |
| 1,479,881 | 1/1924 | Wagner | 137/101.27 |
| 1,533,137 | 4/1925 | Pospisil | 251/294 |
| 1,575,094 | 3/1926 | Bright | 137/398 |
| 1,590,844 | 6/1926 | Moeschen | 251/294 |
| 1,600,162 | 9/1926 | Browne | 73/322.5 |
| 2,358,472 | 9/1914 | Owens | 73/322.5 |
| 2,882,919 | 4/1959 | Brown | 137/101.27 |
| 3,027,910 | 4/1962 | Oliver | 137/397 |

FOREIGN PATENT DOCUMENTS

| | | | |
|---|---|---|---|
| 600964 | 8/1934 | Fed. Rep. of Germany . | |
| 882025 | 7/1953 | Fed. Rep. of Germany . | |
| 2523942 | 3/1979 | Fed. Rep. of Germany . | |
| 3007035 | 12/1982 | Fed. Rep. of Germany . | |
| 848512 | 10/1939 | France | 137/398 |

*Primary Examiner*—G. L. Walton
*Attorney, Agent, or Firm*—Barnes & Thornburg

[57] ABSTRACT

In a discharge regulator for outlets from liquid containers, in particular rain runoff retention reservoirs, in which a regulator plate or diaphragm is guided in front of the outlet opening and is operatively connected to a float by means of transmission elements which may at the same time be control elements, the regulator (1) is guided pivotally in front of the outlet opening (2) and is mounted above the latter on a fixed rotation axis (4) jointly with a disk (3) on a base plate (11). A transmission element (5) or (12) connects the disk (3) to a second upper rotation axis (7) on which a disk (6) is operatively connected to a float arm (8) and then via the latter to the float (9) (FIG. 1). The float (9) and float arm (8) as well as the plate (1) can optionally be arranged on alternate sides. Apart from these components all the other drive and transmission elements may be protected by a hood.

6 Claims, 3 Drawing Figures

DISCHARGE REGULATOR

The invention relates to a discharge regulator for liquid containers, in particular for rain runoff retention chambers, including a valve plate which is pivoted in front of the discharge opening and operatively connected via transmission elements to a float.

In rain runoff retention systems and other reservoirs the amount of water discharged is generally controlled by changing the cross-sectional area of the outlet. However, the closing off of the outlet opening must not take place directly proportionally to the water height. Rather, the rate of outlet closing must decrease with increasing water head.

Such regulators are known for example from DE-PS Nos. 2,523,942 and 3,007,035. In the two known devices a throttle plate is pivoted by means of an extremely projecting and very complicated linkage in front of the discharge opening of the tank, one edge of the throttle plate representing a control curve. The second patent mentioned sets forth an improvement of the drive for the throttle plate disclosed in the first patent. The drive disclosed in the second patent has, however, the disadvantages that it includes two fixed and additionally two movable bearings and consists of a lever system in which dirt can lodge and prevent or greatly impair the control operation. Due to the design, the linkage cannot be protected from such influences.

In addition, due to the design, the prior art control can only be used on one side, i.e. if the float is disposed to the right of the regulator axis it cannot be used on the left, and can be changed only by a laterally inverted construction thereof by the manufacturer. Common production for left and right arrangement is not possible. Moreover, with this prior control the rising and falling float movement can only be transmitted to the closure plate in a direct ratio.

An object of the present invention is therefore to provide a discharge regulator which drives the pivotal regulator plate or diaphragm in simpler and more easily protectable manner with less mechanical expenditure. Another object of the present invention is to provide a discharge regulator which is universally usable and, moreover, by transmission ratios depending on the hydraulic requirements, moves the regulator plate or diaphragm uniformly or more rapidly or slower or in a combined manner. Particularly, the invention achieves a very rapid closing off at the beginning when the water head rises only slowly and the invention retains exactly the controlled amount desired. The more rapid rotary movement allows also for a large release by the plate tip to be reduced to a minimum or even avoided. The range of minimum dam heights up to 2.5×DR, not detectable and controllable in DE-PS No. 3,007,035, is reduced to the hydraulically calculable limit of 1.5 DR above bottom where DR denotes diameter of the regulator opening.

The new regulator consists essentially of the known, now optimized, regulator plate which is situated in front of the vertical opening. A drive and control unit is rotatably mounted above the regulator plate on a stationary axis. The movement of the float is transmitted via a transmission element, for example via a float arm, to a drive element, for example a disk, or a disk cam, which in turn is connected operatively by cables, chains, or the like, to a drive element on the regulator plate axis. For example, a disk or disk cam is provided which then finally effects the necessary rotational movements of the regulator plate. All the components are mounted on a common base plate and, except for the float with its float arm and the regulator plate, protected by a cover. The two axes of rotation preferably are disposed vertically above each other.

Additional features and advantages of the invention will become apparent to those skilled in the art upon consideration of the following detailed description of a preferred embodiment exemplifying the best mode of carrying out the invention as presently perceived.

The detailed description particularly refers to the accompanying figures in which.

Figure 1:
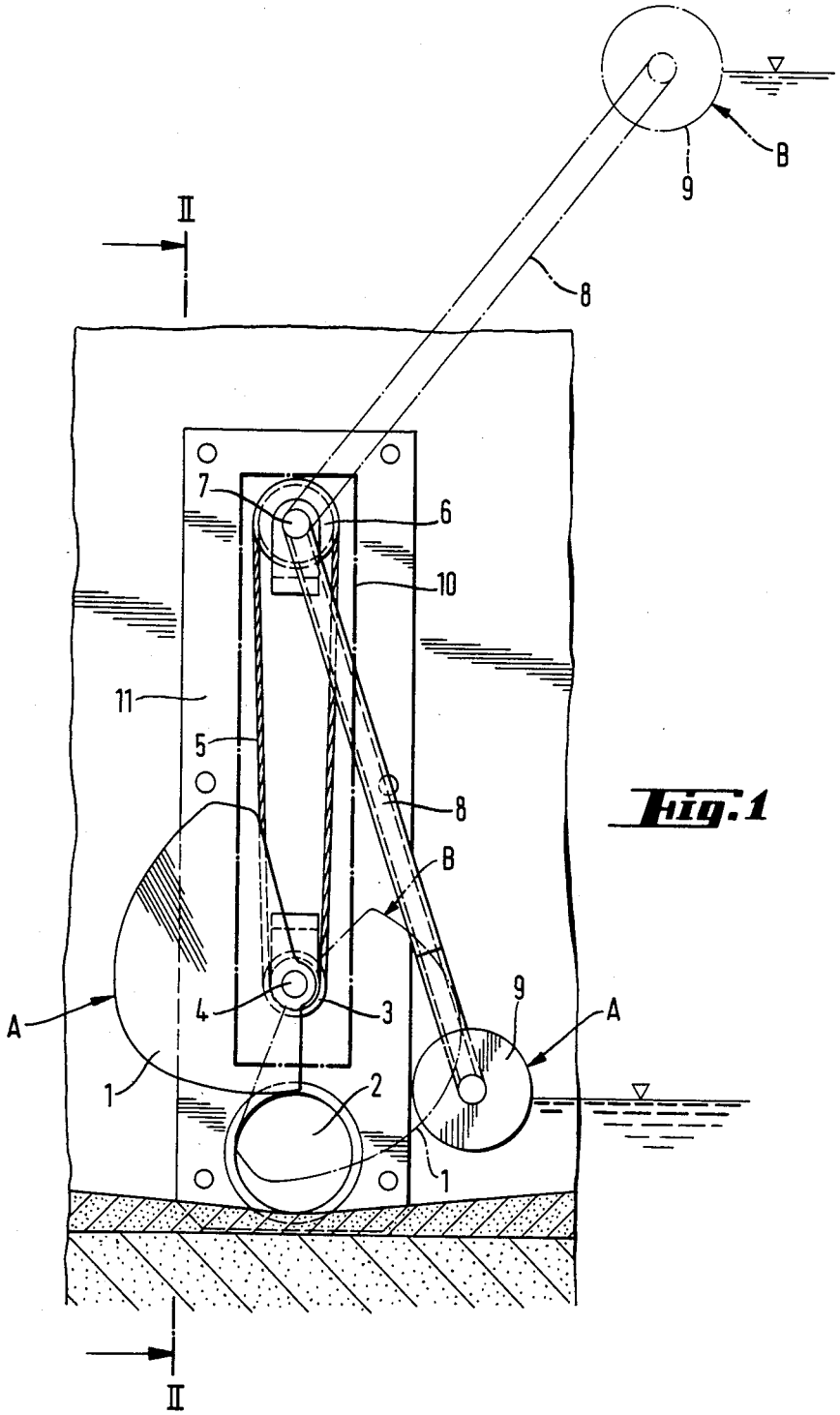
FIG. 1 is a front elevation view of a discharge regulator according to the invention.
Figure 2:
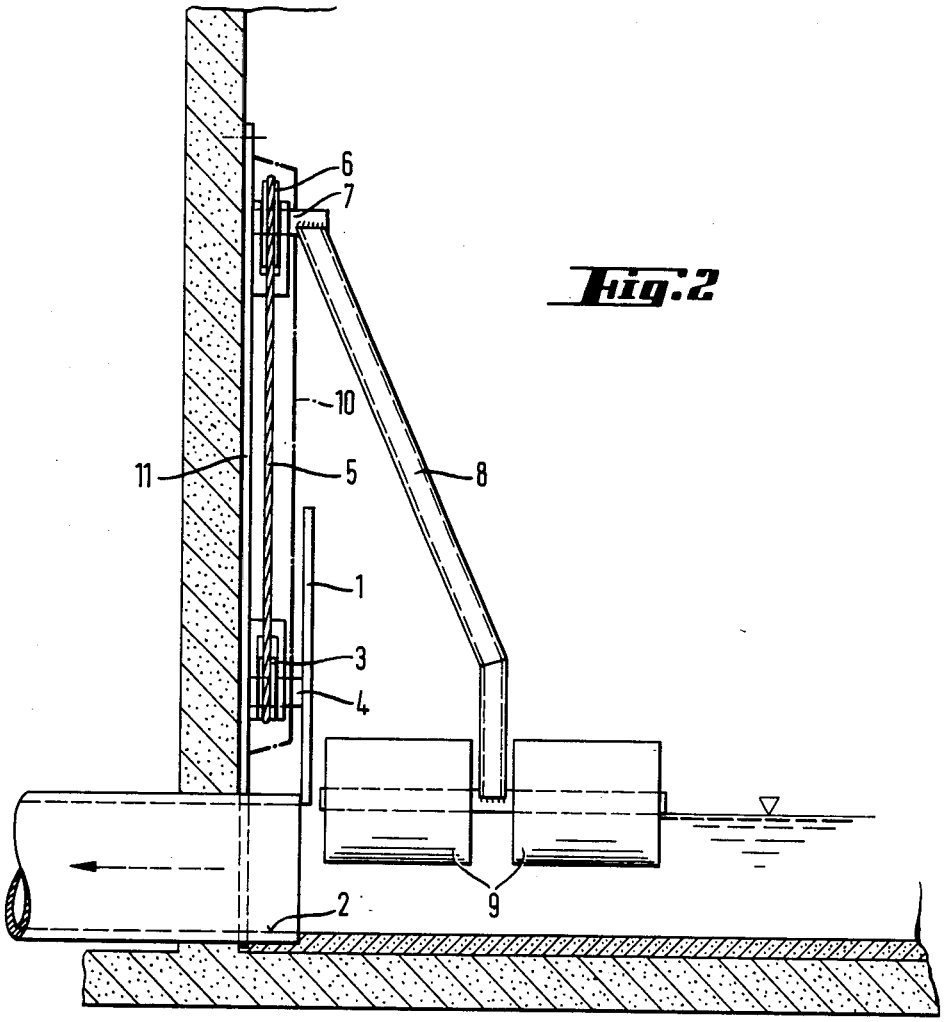
FIG. 2 is a sectional view taken along the line II—II of FIG. 1.

As apparent from FIGS. 1 and 2 the regulator consists of a diaphragm or regulator plate 1 which is positionable across the outlet opening 2 and operatively connected to a drive pulley or disk 3, being rotatably mounted on a common axis 4. A cable 5 runs over a second pulley or disk 6 supported on a second axis of rotation 7 which is operatively connected with the float arm 8 to the float 9. The disk 6 has a greater diameter than the disk 3. This transmission ratio achieves a more rapid closing off of the outlet opening 2. The drive parts sensitive to disturbances are protected from damage, etc., by a hood 10 fixed on the common base plate 11. The base plate 11 and the protective hood 10 may be made in one or more parts.

Figure 3:
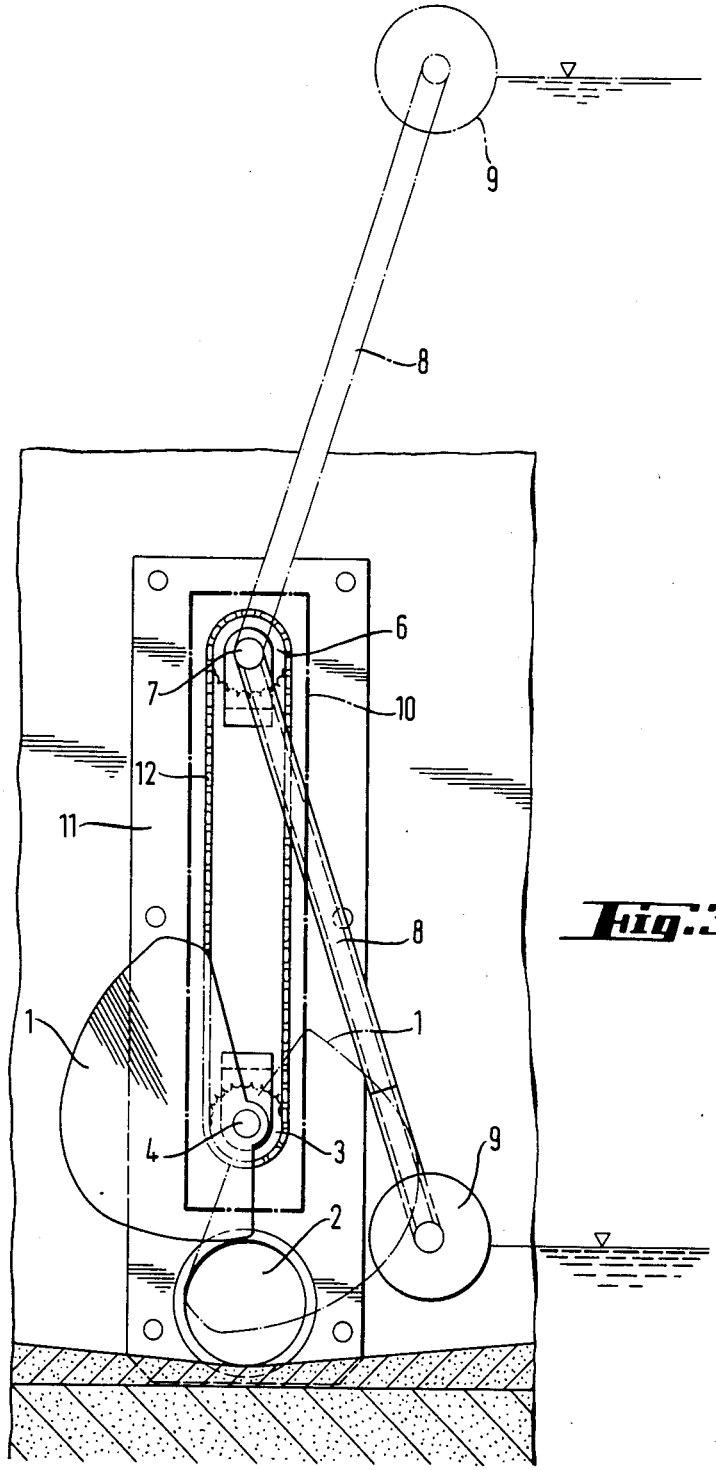
FIG. 3 is a front elevation view of a further discharge regulator according to the invention.

In FIG. 3 another embodiment of the discharge regulator according to the invention is illustrated in which the disk 6 has the same diameter as the disk 3. In this embodiment the two disks 3, 6 are connected together by a chain 12.

The float arm 8 is illustrated to be in the form of a hollow sealed rectangular tube. To clarify the influence of this hollow buoyant float arm 8 on the function of the discharge regulator two possible positions A and B of the float 9 and the plate 1 are indicated in FIG. 1.

In position A the outlet opening 2 is completely open, the plate 1 pivoted out of the outlet opening and the float 9 with the arm 8 is in its lowermost position. Since the regulator plate 1 is rotatably mounted at its edge, a downwardly directed force acts on the plate because of its own weight and presses the float upwardly. To hold the plate in position A the float and the float arm 8 must be made correspondingly heavy.

In position B the situation is the converse because in this case the plate 1 is pivoted upwardly on the other side. The float must now exert a correspondingly high upward force. To obtain the necessary buoyancy the float in the known discharge regulators must have a correspondingly large volume. Since the float arm 8 is also made as a buoyant hollow body in the position B in which it is immersed in the liquid it is likewise subjected to a lifting force. The upward movement of the float 9 is thus supported by the float arm 8, as soon as the latter is immersed in the liquid from its horizontal position upwards. A large-volume float is therefore not necessary.

Although the invention has been described in detail with reference to certain preferred embodiments, variations and modifications exist within the scope and spirit of the invention as described and as defined in the following claims.

What is claimed is:

1. A discharge regulator for a liquid reservoir outlet comprising a lower disc rotatably mounted on a first axis adjacent the reservoir outlet, a regulator plate positioned on the first axis for rotation with the lower disc in front of the reservoir outlet, an upper disc rotatably mounted on a second axis above the first axis, an arm having a proximal end positioned on the second axis for rotation with the upper disc, a float positioned on the distal end of the arm, and rotatably means connecting the upper disc and lower disc, the float arm being rotatable in response to changes in the liquid level in the reservoir sensed by the float to cause the upper disc to rotate for causing movement of the connecting means to rotate the lower disc for moving the regulator plate relative to the outlet, the float arm being constructed as a buoyant hollow body so that the float arm is subjected to a lifting force when it is immersed in liquid to aid in supporting the float in the liquid.

2. A valve system for regulating discharge of liquid from an outlet of a liquid reservoir, the height of liquid in the reservoir defining a liquid head, the valve system comprising float means for sensing the height of liquid in the liquid reservoir, the float means being movable between a lowest float level and a highest float level in response to a change in the height of the liquid within the liquid reservoir, the effective size of the outlet opening being greatest when the float means is at the lowest float level, closure means for varying the effective size of the opening of the outlet in response to movement of the float means, the closure means further includes a lower disc rotatably mounted on a first axis adjacent the reservoir outlet, a regulator plate positioned on the first axis for rotation with the lower disc in front of the reservoir outlet, an upper disc rotatably mounted on a second axis above the first axis, an arm having a proximal end positioned on the second axis for rotation with the upper disc and a distal end coupled to the float means, and means rotatably connecting the upper disc and lower disc, the rotation of the upper disc causing the connecting means to rotate the lower disc for causing movement of the regulator plate relative to the outlet in response to changes of the liquid level in the reservoir sensed by the float means, the regulator plate being configured to progressively reduce the rate of change in the effective size of the opening of the outlet in response to movement of the float means from the lowest float level toward the highest float level so that the rate of outlet closing decreases as the liquid head increases.

3. The valve system of claim 2, wherein the connecting means comprises a cable looped around both the upper and lower discs.

4. The valve system of claim 2, wherein the upper and lower discs each comprise a sprocket and the connecting means comprises a chain engaging both sprockets.

5. The valve system of claim 2, wherein the arm comprises a hollow buoyant body.

6. The valve system of claim 2, further comprising a base plate fixed adjacent the reservoir outlet, and a hood surrounding the upper and lower discs and the connecting means, the hood being secured to the base plate, the first and second axes projecting through the hood.

* * * * *